US005915295A

United States Patent [19]

Lauderbaugh

[11] Patent Number: 5,915,295

[45] Date of Patent: Jun. 29, 1999

[54] MACHINE FOR MANUFACTURING CORRUGATED BOARD WITH HEAT EXCHANGERS ON BOTH SIDES OF THE BOARD

[75] Inventor: David Lauderbaugh, Roswell, Ga.

[73] Assignee: Corrugated Gear and Services, Inc., Alpharetta, Ga.

[21] Appl. No.: 08/950,936

[22] Filed: Oct. 15, 1997

[51] Int. Cl.[6] ..... B30B 15/34

[52] U.S. Cl. ..... 100/38; 100/154; 100/308; 100/309; 100/311; 156/206; 156/470; 156/583.5

[58] Field of Search ..... 100/38, 151, 154, 100/306–314; 156/206, 470, 499, 555, 583.5

[56] References Cited

U.S. PATENT DOCUMENTS

| | | | |
|---|---|---|---|
| 905,076 | 11/1908 | Hinde . | |
| 2,135,763 | 11/1938 | Nicholson | 100/308 |
| 2,142,932 | 1/1939 | Beard | 100/308 |
| 3,345,237 | 10/1967 | Browning et al. | 100/311 |
| 3,580,795 | 5/1971 | Eichenlaub | 156/583.5 |
| 4,016,021 | 4/1977 | La Fleur . | |
| 4,127,945 | 12/1978 | Nöthen et al. . | |
| 4,169,007 | 9/1979 | Pray . | |
| 4,174,237 | 11/1979 | Hemming, Jr. et al. . | |
| 4,556,444 | 12/1985 | Schommler | 156/470 |
| 4,560,431 | 12/1985 | Inselmann | 100/312 |
| 5,183,525 | 2/1993 | Thomas . | |
| 5,466,329 | 11/1995 | Marschke . | |
| 5,501,764 | 3/1996 | Inselmann | 100/313 |
| 5,578,160 | 11/1996 | Krznarich et al. . | |
| 5,604,990 | 2/1997 | Takekoshi . | |
| 5,611,267 | 3/1997 | Lauderbaugh . | |
| 5,632,830 | 5/1997 | Marschke . | |
| 5,788,803 | 8/1998 | Sissons et al. | 156/470 |

*Primary Examiner*—Stephen F. Gerrity
*Attorney, Agent, or Firm*—Jones & Askew, LLP

[57] ABSTRACT

A machine and method for manufacturing corrugated board, including several machines for applying heat to both sides of the corrugated board during the manufacturing process. Different types of heat exchangers may be used on the top and bottom sides of the moving surface to transfer sufficient heat to the moving surface, to remove moisture and to cure the adhesive of the corrugated board. Independently controlled heat exchangers enable the manufacturer to regulate the heat applied to the corrugated board across the width of the machine and in the direction of the machine flow, in response to varying the desired width and thickness of corrugated board. Unused areas of the hotplate section may be isolated to minimize the heat loss in the machine when narrow width corrugated board is manufactured.

29 Claims, 9 Drawing Sheets

120
142
111
140c
140b
140a
108
130c
130b
130a
139
BOARD FLOW
110
107

MACHINE FOR MANUFACTURING CORRUGATED BOARD WITH HEAT EXCHANGERS ON BOTH SIDES OF THE BOARD

FIELD OF THE INVENTION

This invention generally relates to the corrugated board industry and, more particularly, to a machine that includes heat exchangers on both sides of a moving board for manufacturing thick grades of corrugated board.

BACKGROUND OF THE INVENTION

Corrugated board can be manufactured in many different widths and thicknesses. The thickness of the corrugated board is determined by the number of medians and liners in the board. First, corrugations or ridges are created in a median by passing the median through a corrugator. Then, an alternating series of liners and medians, with an adhesive between each layer, are brought together in a moving surface to a form a corrugated board of desired thickness. The moving surface passes through an assembly line that includes a hotplate section, where heat and pressure are applied to dry the board and set the adhesive, and a cooling section, where the corrugated board is cooled. The moving surface is then cut and scored to make corrugated board of different shapes and sizes for boxes and other items.

The hotplate section includes a heated platform, typically a series of steam chests, that heat the corrugated board to set the adhesive and to remove moisture from the medians and liners. An array of pressure applicators press the corrugated board against the heated platform to assist in moisture removal and heat transfer. The pressure applicators press the corrugated board against the steam chest to ensure adhesion across the entire width of the corrugated board to prevent blisters from forming in the corrugated board.

Because the steam chests tend to warp over time, usually with a sag in the middle, a rigid pressure applicator would crush the edges of the corrugated board and leave blisters in the middle of the board. Many machines are also configured to manufacture corrugated board of varying width. These machines should be capable of varying the pressure applied across the machine width because the edges of the corrugated board, which are only supported by adjacent corrugated board on one side, are easier to crush than the middle of the corrugated board. In addition, it may be desirable to vary the pressure in the cross-machine direction in response to variable moisture content in the board. Specifically, it may be advantageous to apply extra pressure to wetter areas of the board. Multi-foot pressure applicators have been developed for applying variable pressure across the width of the steam chest (i.e. in the cross-machine direction).

In a typical configuration, the hotplate section of a machine for manufacturing corrugated board includes 16 steam chests that are 7.3 feet (2.2 m) wide and extend in combination about 21 feet (6.5 m) in the direction of machine flow. A row of eight pressure applicators may overlie each steam chest in the cross-machine direction. This allows pressure to be applied over more steam chests for thicker corrugated board and at higher machine speeds. For example, pressure may be applied over only four steam chests (i.e., one group) for single-median corrugated board, over eight steam chests (i.e., two groups) for double-median corrugated board, and over all sixteen steam chests (i.e., four groups) for triple-median corrugated board. In addition, to increase the production output of thinner gauges of board, the machine speed may be increased and pressure may be applied over more steam chests. The hotplate section thus includes a grid of pressure applicators including rows of applicators in the cross-machine direction and columns of applicators in the direction of machine flow.

The conventional configuration described above has certain shortcomings when used to manufacture thick corrugated board, such as triple-median board. Namely, it is difficult to transfer heat from the steam chests all the way through to the top layers of the board. The thicker corrugated board therefore requires more time in the hotplate section to bring the temperature of the top layers of adhesive to the required setting temperature. It is also difficult to remove moisture from wet areas in the top layers, which can cause the board to warp as it dries. To counteract these problems, the speed of the board must be slowed considerably to ensure adequate moisture removal from the top layers of the board and adequate heating of the top layers of adhesive. This decrease in the speed of the assembly line decreases the production output and increases the cost of the thick corrugated board.

Moreover, the corrugator belt propels the top layer of the board through the hotplate section while the bottom layer is in sliding contact with the stationary top surface of the steam chests. The drag on the bottom side of the board tends to separate the bottom layer from the top layer. Therefore, if inadequate heat is applied to set the adhesive early in hotplate section, the top layer tend to slide in relation to the bottom layers, which smears the adhesive and forms a poorly bonded board known as "zipper board." And simply increasing the temperature of the steam chests does not solve the problem. This is because overheating the bottom layers of the board can over-dry the board and crystallize the adhesive, which also creates "zipper board."

Overcoming these problems requires moderate heat in the steam chests and further slowing of the assembly line to reduce the drag on the bottom of the board and set the adhesive without overheating the bottom layers of adhesive or separating the layers of the board. Manufacturing thick corrugated boards using a conventional pressure applicator and steam chest arrangement can therefore be quite costly, as an extreme decrease in the speed of the assembly line may be necessary. In a typical configuration, for example, the machine speed may have to be reduced from a preferred linear speed of 500 feet (15.2 m) per minute to 150 feet (4.6 m) per minute or less when manufacturing triple-median board.

Changing the thickness of the corrugated board while continuously running the assembly line is another objective when manufacturing corrugated board. By adding or removing adhering layers, the thickness of the corrugated board can be changed while the board continuously runs through the hotplate section. If the assembly line has to be stopped to accommodate changes in the thickness of the corrugated board, or to adjust the heat to be applied, then the assembly line must then be restarted, resulting in a reduction in the manufacturing output of corrugated board.

Changing the width of the corrugated board while continuously running the assembly line is another objective when manufacturing corrugated board. By changing the width of the medians and liners entering the hotplate section, the width of the manufactured corrugated board can be changed. In a conventional machine for manufacturing corrugated board, the heat applied to the different widths of corrugated board cannot be regulated in the cross-machine direction, resulting in excessive heat loss when manufacturing narrow board.

Conventional machines for manufacturing corrugated board are expensive pieces of equipment that may be restricted to specific physical parameters depending upon the configuration and availability of space in the manufacturing plant and the size and configuration of the existing machine. To improve the control response of an existing machine for manufacturing corrugated board, it is often desirable to retrofit the existing machine within the physical limitations imposed by the configuration of the manufacturing plant.

In summary, there is a need for an improved machine for manufacturing thick corrugated board, such as triple-median board. Specifically, there is a need to increase the rate of heat transfer and moisture evaporation, without decreasing the speed of the assembly line, when manufacturing thick corrugated board. There is a further need to retrofit conventional machines for manufacturing corrugated board to increase the rate of heat transfer and moisture evaporation, without decreasing the speed of the assembly line, when manufacturing thick corrugated board.

SUMMARY OF THE INVENTION

The present invention satisfies the needs described above by providing a machine and method for manufacturing thick corrugated board, such as triple-median board. The invention includes various configurations for applying heat to both sides of the corrugated board during the manufacturing process. A conveyor propels the board to form a moving surface that travels over a heated platform, such as a series of steam chests forming a hotplate section, so that the bottom side of the moving surface is in sliding contact with the heated platform. A number of pressure applicators located above the moving surface press the board against the heated platform as the as the board moves between the pressure applicators and the heated platform. This removes moisture from, and sets the adhesive between, the bottom layers of the thick-walled corrugated board. A number of top-side heat exchangers located above the moving surface apply heat to the top side of the moving surface to remove moisture from, and set the adhesive between, the top layers of the thick-walled corrugated board.

In a machine with a beltless hotplate section, the conveyor may be a pair of conveyor belts, or another suitable pulling device, located downstream from the hotplate section. In this case, the top-side heat exchangers are usually located between pressure applicator sections and near the front of the hotplate section to ensure proper setting of the adhesive in the top layers of the board early in the assembly line. This configuration is particularly suitable for a new machine with a beltless hotplate section, or for a comprehensive retrofit for an existing machine so that the retrofitted machine includes a beltless hotplate section. Alternatively, the conveyor may be a conventional conveyor belt positioned between the pressure applicators and the top side of the moving surface. In this case, the top-side heat exchangers are usually located downstream from the hotplate section. This configuration is particularly suitable for a less comprehensive retrofit for an existing machine that will have a belt-driven hotplate section after the retrofit.

According to an aspect of the invention, the top-side heat exchanger is divided into segments in the cross-machine direction. This allows unneeded segments to be turned off when manufacturing narrow corrugated board. The heat may also be varied in the cross-machine direction in response to uneven moisture content in the top medians and liners. For example, the heat may be increased over wetter areas of the top side of the board. A control device is therefore deployed to regulate the heat applied by top-side heat exchangers in the cross-machine direction in response to the width and moisture content of the top layers of the corrugated board. The top-side heat exchanger may also be divided into segments in the direction of machine flow to provide additional control over the heat applied to the top side of the board. In this case, the control device also regulates the heat applied by top-side heat exchangers in the direction of machine flow in response to the thickness of the board and the speed of machine flow.

According to another aspect of the invention, there are several types of top-side heat exchanger. For example, air flow from a forced-draft air fan may be directed through a steam-fed heat exchanger coil to convectively heat the top side of the corrugated board. Alternatively, an electrical resistance element may be located inside the feet of the pressure applicators to construct heat exchangers that are structurally integral with the pressure applicators. This configuration is most suitable for a machine with a beltless hotplate section so that the heated pressure applicators may be placed in direct contact with the corrugated board. For a machine with a belt-driven hotplate section, many different types of top-side heat exchangers may be deployed downstream from the hotplate section, such as convective heat exchangers, heated rollers, heated plates, and so forth.

Accordingly, it is an object of the invention to provide an improved machine for manufacturing thick corrugated board including heat exchangers on both sides of the corrugated board. It is another object of the invention to retrofit an existing machine to include heat exchangers on both sides of the corrugated board in existing machines within the space limitations of the existing machines. Additional features and advantages of the invention will become apparent to one skilled in the art from the following detailed description of the preferred embodiments and the appended drawings and claims.

DETAILED DESCRIPTION OF THE PREFERRED EMBODIMENTS

Several embodiments of the present invention are described below and illustrated in the accompanying drawings. Each embodiment is a machine for manufacturing corrugated board using pressure applicators on one side of the board and heat exchangers on both sides of a moving board. In all of the embodiments, the use of heat exchangers on both sides of the moving board increases the heat transfer to the corrugated board, thus ensuring adequate moisture removal from the corrugated board and an adequate setting of the adhesive between the layers of the corrugated board. The use of top-side heat exchangers allow thick corrugated board to be manufactured at increased machine speed. Independently controlled top-side heat exchangers, which may vary the heat applied to the top side of the board in the cross-machine direction and in the direction of the machine flow, allow the manufacturer to control the rate of heat transfer in response to changes in the speed of the machine as well as changes in the thickness, width, and moisture content of the board.

Suitable pressure applicators for the use in the described embodiments are described in U.S. Pat. No. 5,611,267, entitled "Apparatus and Method For Applying Variable Pressure To A Surface In Corrugated PaperBoard Manufacturing," inventor David Lauderbaugh, assigned to Corrugated Gear and Services, Inc., which is incorporated herein by reference.

Machines With Beltless Hotplate Sections

Figure 1:
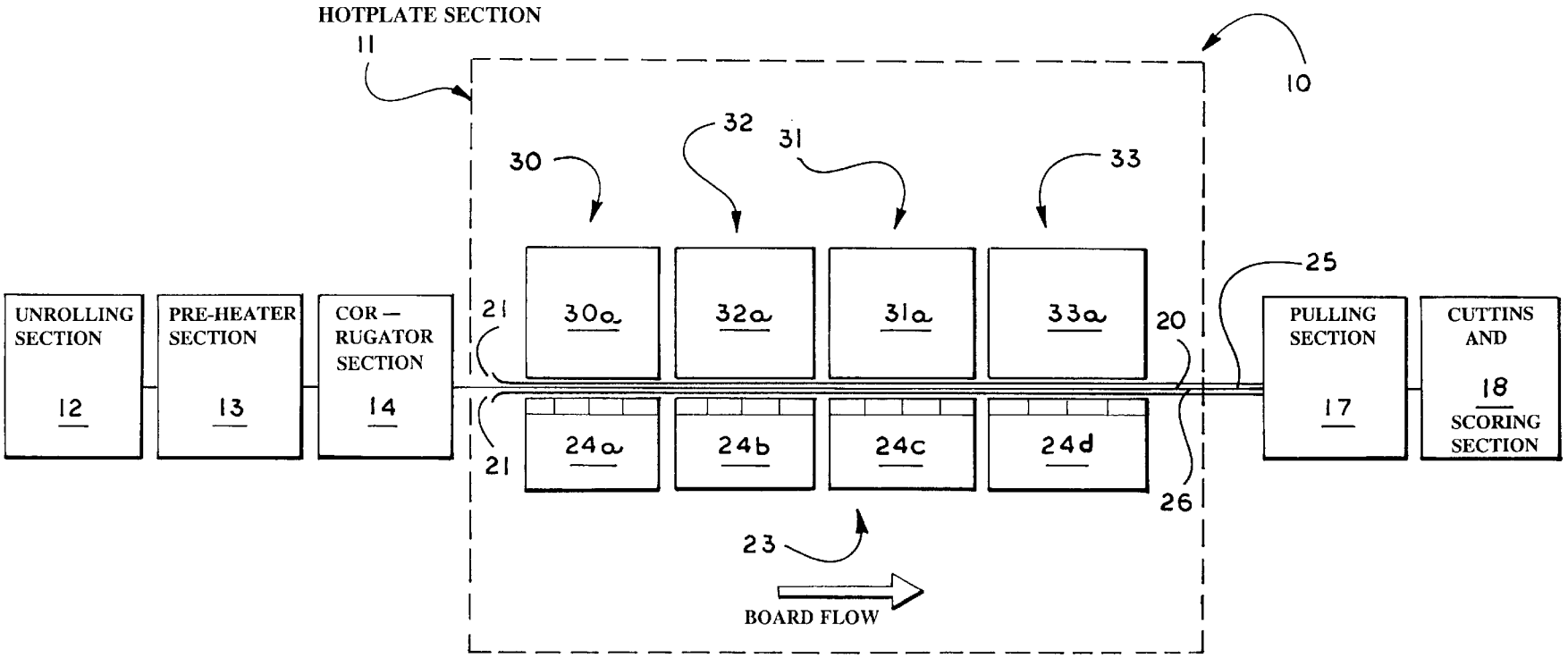
FIG. 1 is a schematic diagram in accordance with an embodiment of the invention showing a machine for manufacturing corrugated board including top-side heat exchangers located in a beltless hotplate section.

Turning now to the drawings, in which like numerals indicate like elements, FIG. 1 is a schematic diagram of a machine 10 for manufacturing corrugated board. The machine 10 includes a beltless hotplate section 11 with a heated platform 23 opposing an alternating series of pressure applicator sections 30*a*, 31*a* and top-side heat exchanger sections 32*a*, 33*a*. Because this configuration is preferably deployed in a machine with a beltless hotplate section 11, it is most suitable for a new machine or for retrofitting an existing machine that will include a beltless hotplate section after the retrofit.

The manufacturing process begins with an unrolling section 12 for unwinding pre-made rolls of liners and medians for the formation of the corrugated board. Continuous sheets of liners and medians are fed into a pre-heater section 13, which dries the liners and medians prior to entering the corrugator section 14. When the medians enter the corrugator section 14, the corrugator mechanically creates ridges in the medians. Then an alternating series of liners and medians are brought together to form a moving board 20 with an adhesive 21 applied between each alternating liner and median. The moving board 20 then enters the hotplate section 11, which further dries the board and sets the adhesive 21 through the application of heat and pressure. From the hotplate section 11, the board 20 enters a pulling section 17 and then a cutting, scoring, and stacking section 18 to produce corrugated board blanks of different shapes and sizes for boxes and other items.

Figure 2:
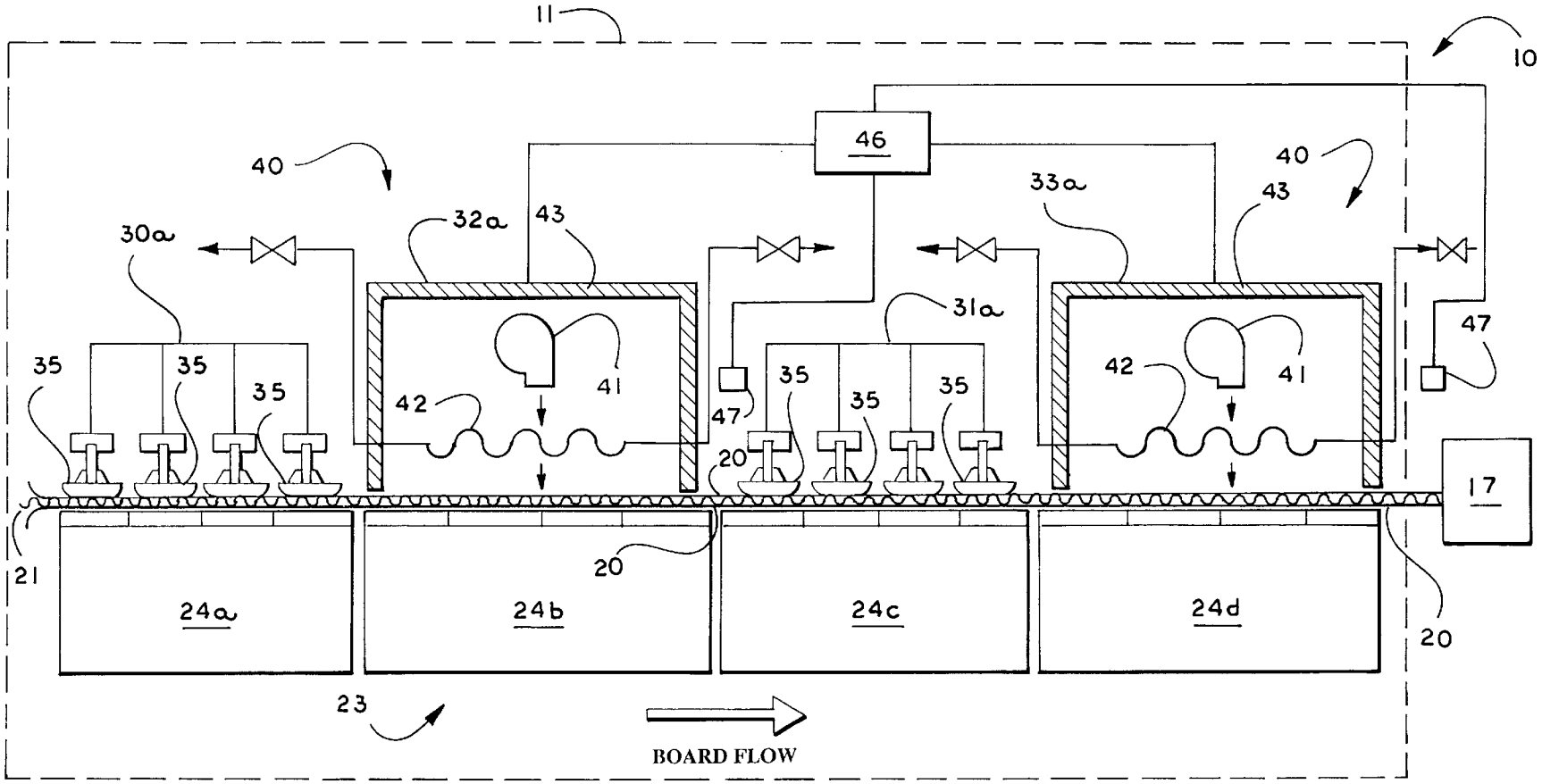
FIG. 2 is a schematic diagram of the hotplate section of the machine illustrated in FIG. 1, which includes alternating pressure applicator sections and top-side heat exchanger sections in the direction of machine flow.

As shown in FIGS. 1 and 2, a pulling section 17 located immediately downstream of the hotplate section 11 propels the board 20 through the hotplate section 11. The pulling section 17 allows the hotplate section 11 to be beltless, which advantageously avoids the down time and expense associated with periodic replacement of a hotplate section conveyor belt. The pulling section 17 typically includes two conveyor belts, one located adjacent the top side of the board 20 and the other adjacent the bottom side of the board. Because the conveyor belts in the pulling section 17 are not in sliding contact with the feet of the pressure applicators, these belts wear out less frequently than the hotplate section belt in a conventional machine with a belt-driven hotplate section. A machine with a beltless hotplate section is described in U.S. Pat. No. 5,732,622 (application Ser. No. 08/788,923), which is entitled "Machine for Manufacturing Corrugated Board," inventor David Lauderbaugh, assigned to Corrugated Gear and Services, Inc., which is incorporated herein by reference.

The pulling section 17 propels the board 20 over the top side of the heated platform 23, which for convenience is shown as a series of steam chest sections 24*a–d* aligned from 24*a* to 24*d* in the direction of machine flow. In a typical configuration, the hot plate 11 section includes 16 steam chests that are each about 88 inches (223.5 cm) in the cross-machine direction and 16 inches (40.6 cm) in the direction of machine flow. For example, in the configuration shown in FIG. 1, each steam chest section 24*a–d* is a group of four adjacent steam chests. In an alternative configuration, the hot plate section may include 24 steam chests that are each about 88 inches (223.5 cm) in the cross-machine direction and 12 inches (30.5 cm) in the direction of machine flow.

FIG. 2 is a schematic diagram of the hotplate section 11 of the machine 10. In the direction of machine flow, the hotplate section 11 includes alternating pressure applicator sections 30, 31 and top-side heat exchanger sections 32, 33 located above the heated platform 23. In the pressure applicator sections 30 and 31, each row of pressure applicators extends in the cross-machine and overlies a steam chest. Thus, the first pressure applicator section 30 includes four rows of pressure applicators with each row overlying a steam chest of the first steam chest section 24*a*. The first top-side heat exchanger section 32 overlies the second steam chest section 24*b*. The second pressure applicator section 31 includes four rows of pressure applicators with each row overlying a steam chest of the third steam chest section 24*c*. And the second top-side heat exchanger section 33 overlies the fourth steam chest section 24*d*.

Figure 4:
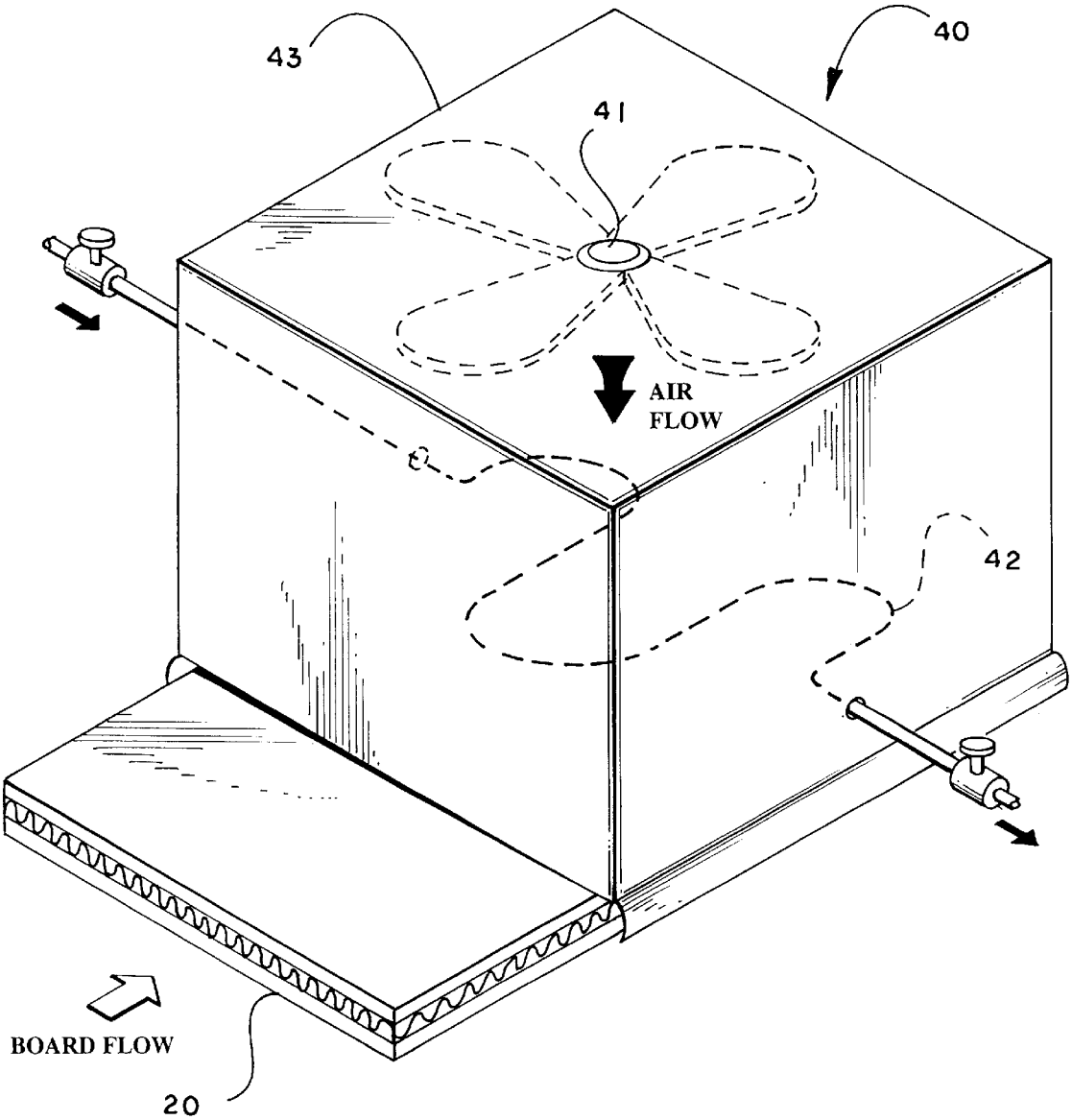
FIG. 4 is a diagram of an illustrative top-side heat exchanger including a forced-air fan and steam-fed coil.

There are several types of heat exchangers that may be employed in any of the embodiments of the invention described herein. For example, as shown in FIG. 2, the top-side heat exchangers 32*a* and 33*a* may utilize a forced-air heat exchanger 40, which is shown best in FIG. 4. The forced-air heat exchanger 40 includes a forced-air draft fan 41 positioned above a heating element 42, which is heated by steam from a boiler, an electric heating element, or another suitable heat source. The fan 41 forces air through the heating element 42 and onto the top side of the moving surface 20. A containment hood 43 is positioned over the steam chest section 24*b* to recover a portion the heated air, which is returned to the input-side of the fan 41. The forced air exiting the fan 41, which is convectively heated by the heating element 42, impacts the top side of a moving surface 20, transferring the heat from the air to the top side of a moving surface 20.

A control device 46 regulates the heat applied by the top-side heat exchangers 32*a* and 33*a* in the cross machine direction in response to changes in the width and wetness of the board 20. This allows unneeded segments of the top-side heat exchangers 32*a* and 33*a* to be turned off when the board 20 is narrower than the top-side heat exchangers 32*a* and 33*a*. This also allows the heat to be turned up over wetter sections of the board 20. Because the top-side heat exchangers 32*a* and 33*a* are independently controlled, the control device 46 also controls the heat applied by the top-side heat exchangers in the direction of the machine flow. This allows the heat applied by the top-side heat exchangers to be changed in response to the thickness of the board 20 and the speed of machine flow.

In addition, a temperature sensor assembly 47, such as a row of infrared sensors in the cross-machine direction, may be positioned above the board 20 at the downstream end of the hotplate section 11. The temperature sensor assembly 47 obtains a temperature profile of the board 20 in the cross-machine direction. This temperature profile is used as a feedback control parameter for the control device 46. Thus, the heat applied by the top-side heat exchangers 32*a* and 33*a* may be regulated in the cross-machine direction and in the direction of machine flow in response to the measured temperature profile. It will be appreciated that an additional temperature sensor assembly may be positioned above the board 20 at other locations in the hotplate section 11. For example, in the configuration shown in FIG. 2, the temperature sensor assembly may be positioned immediately downstream from the first top-side heat exchanger 32*a*, as indicated by the temperature sensor assembly 47'. This configuration may be desirable for ensuring that the adhesive 21 in the top layers of the board 20 has been set by the time the board 20 reaches the downstream from the first top-side heat exchanger 32*a*. It will also be appreciated that multiple temperature sensor assemblies, such as the assemblies 47 and 47' or other combinations, may be may be used.

The application of heat to the top side of the moving board 20, in conjunction with the application pressure to press the bottom side of the moving surface 20 against the heated platform 23, dries the moving surface and sets the adhesive 21 in the both the top and bottom layers of the moving board 20. Advantageously, the top-side heat exchangers 32 are located between the pressure applicator sections 30 and 31 and near the front of the hotplate section 11 to ensure proper setting of the adhesive in the top layers of the board 20 early in the assembly line. Manufacturing thick corrugated boards with this arrangement can therefore be quite cost effective, as the speed of the assembly line may be maintained at a preferred linear speed, such as 500 feet (15.2 m) per minute per minute or more, when manufacturing triple-median board. And thinner grades of board may be run at even greater machine speeds.

Figure 3:
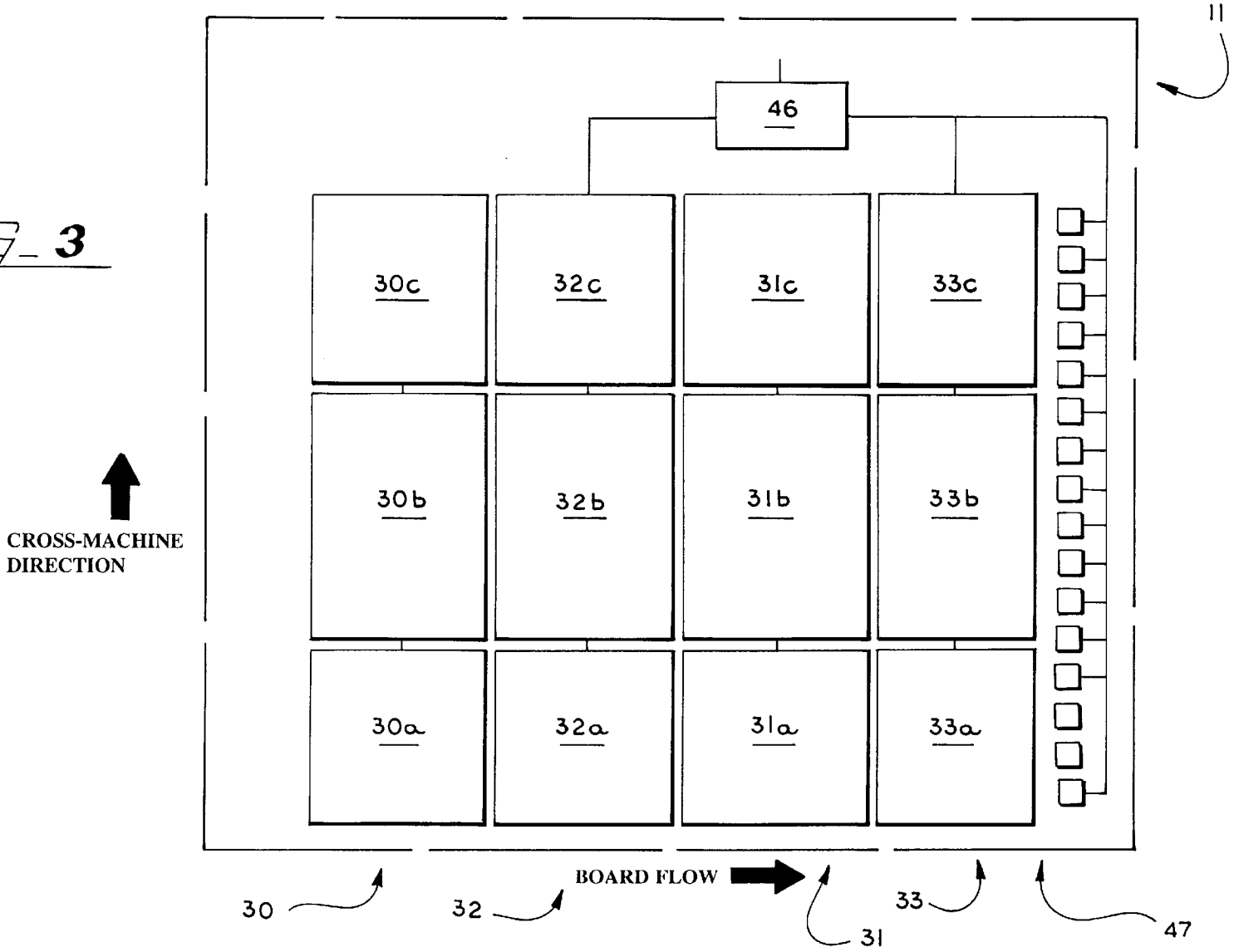
FIG. 3 is a top view of the machine illustrated in FIG. 1, showing that the top-side heat exchanger sections are segmented in the cross machine direction.

FIG. 3 is a top view of the hotplate section 11, showing that the top-side heat exchanger sections 32 and 33 are segmented in the cross machine direction forming independently regulated heat exchanger zones 32*a–c* and 33*a–c*. Thus, both the top-side heat exchangers 32*a–c* and 33*a–c* and the pressure applicators 30*a–c* and 31*a–c* are arranged into independently regulated two-dimensional grids. This allows two-dimensional control over the heat and pressure applied to the top side of the moving board 20, which provides great flexibility for adjusting the rate of heat transfer in response to changes in the speed of the machine as well as changes in the thickness, width, and moisture content of the board 20. Although the grid arrangement shown in FIG. 3 is suitable for manufacturing thick grades of corrugated board at high machine speeds with a modest amount control equipment, one skilled in the art will appreciate that the top-side heat exchangers, pressure applicators, and temperature sensor assemblies may equivalently be arranged in any number of row-and-column combinations. In particular, the machine designer may organize the top-side heat exchangers, pressure applicators, and temperature sensor assemblies to optimize the trade-off between the cost of the machine and the fineness of the control characteristics given the expected use of the machine.

For example, the pressure applicator sections 32 and 33 may be grouped into independently regulated zones 30*a–c* and 31*a–c* in the cross-machine direction corresponding to the heat exchanger zones 32*a–c* and 33*a–c*. Grouping the pressure applicator sections into independently regulated zones reduces the cost of the machine, as fewer pressure regulators are required. Limiting the number of independently-controlled top-side heat exchanger sections similarly reduces the cost of the machine. The trade-off for reducing the number of independently-controlled segments is decreased control over the temperature and pressure profile applied to the board 20. Thus, a balance must be struck between machine cost and control characteristics in view of the intended use of the machine 10. The configuration shown in FIG. 3 may be preferred if primarily full-width board is to be manufactured. Alternatively, if frequent changes in the width of the board 20 are anticipated, an increased number of independently regulated segments may be provided in the cross-machine direction. And if frequent changes in the thickness of the board 20 are anticipated, an increased number of independently regulated segments may be provided in the direction of machine flow.

Machines With Belt-Driven Hotplate Sections

Figure 5:
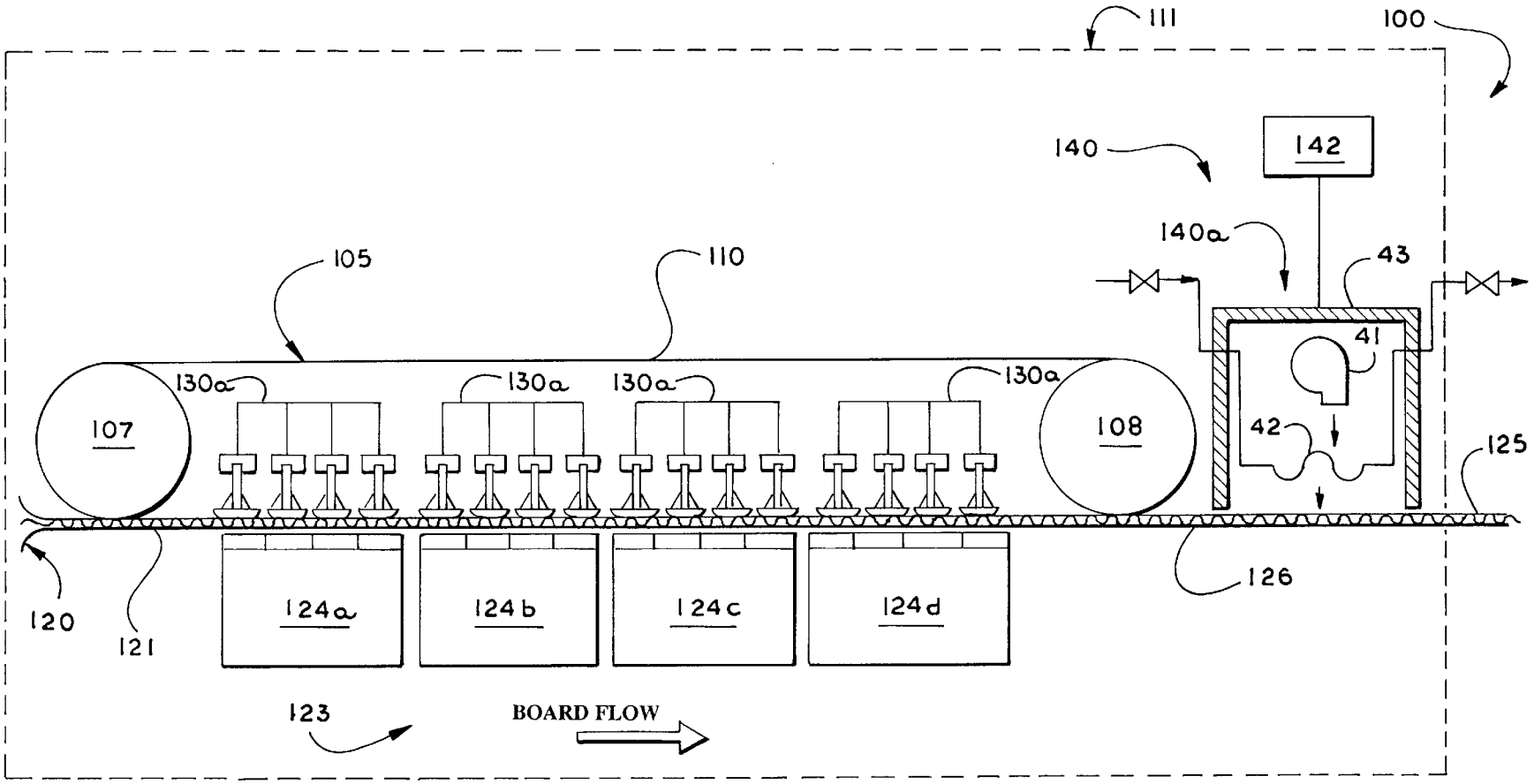
FIG. 5 is a schematic diagram of machine for manufacturing corrugated board with a belt-driven hotplate section including a top-side heat exchanger section located downstream from the hotplate section.
Figure 6:
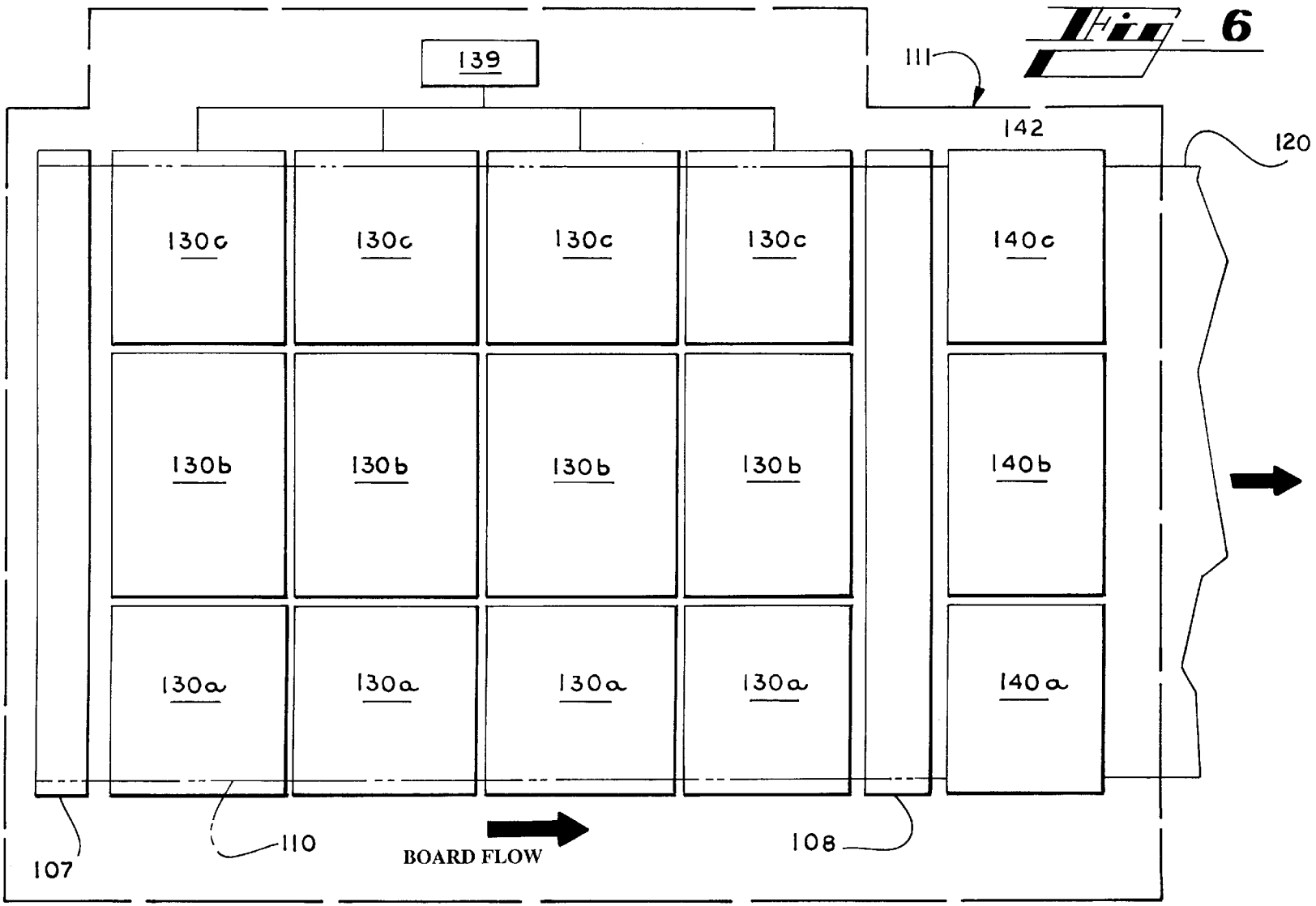
FIG. 6 is a top view of the machine illustrated in FIG. 5, which shows that the top-side heat exchanger sections are segmented in the cross machine direction and in the direction of machine flow.

Although the machine 10 described above with reference to FIGS. 1–4 is preferred for a new machine configuration, there are many existing machines that may benefit from retrofitting with top-side heat exchangers. In some cases, it may be feasible to retrofit an existing machine to include a beltless hotplate section, in which case the retrofitted machine may be configured like the machine 10. But in other cases, this type of comprehensive retrofit may not be cost effective. Other retrofit arrangements that may be deployed for machines with belt-driven hotplate sections. FIGS. 5 and 6 illustrate a retrofitted machine 100 for manufacturing corrugated board that includes a forced-air heat exchanger 140 located downstream from its hotplate section 123.

As shown in FIG. 5, this belt-driven machine 100 includes a belt-driven conveyor 105 with a first belt roller 107 and a second belt roller 108 located downstream from the first belt roller. A conveyor belt 110 stretches tangentially between and travels around the belt rollers 107 and 108. Like the machine 10 illustrated in FIGS. 1–3, the machine 100 includes a hotplate section 111 including a heated platform 123 opposed by a grid of pressure applicators 130*a–d* for pressing the moving board 120 against the heated platform 123. The conveyor belt 110, which is positioned between the pressure applicators 130*a–d* and the top of the moving board 120, propels the board through the hotplate section 111. Thus, the moving surface 120 has a top side 125 and a bottom side 126. The top side 125 of the moving surface 120 is proximate to the conveyor belt 110 and the bottom side 126 of the moving surface is proximate with the top side of the heated platform 123 as the moving surface passes through the hotplate section 111.

The pressure applicator sections 130*a–c* press the conveyor belt 110 against the top side 125 of the moving board 120. As shown in FIG. 6, the pressure applicator sections 130*a–c* are segmented in the direction of machine flow and in the cross-machine direction. The pressure applied by each of the pressure applicator segments 130*a–c* across the width of the machine 100 is regulated by a control device in response to changes in the width, thickness, wetness of the moving surface 120, and in response to the speed at which the moving surface 120 travels through the machine 100.

Illustrated in FIGS. 5 and 6, heat exchanger sections 140*a–c* are located downstream from the pressure applicator sections 130*a–c* and the second belt roller 108, and above the top side 125 of the moving surface 120. The heat exchanger sections 140*a–c* apply heat to the top side 125 of the moving surface 120 while the moving surface moves proximate with the top side of the heated platform 123. The heat exchanger sections 140*a–c* have the same configuration as the forced-air draft fan heat exchanger configuration 40 described previously and shown in FIG. 4. Additional heat exchangers sections can be located downstream of the heat exchanger sections 140*a–c* to apply additional heat to the top side 125 of the moving surface 120 while the moving surface moves proximate with the top side of the heated platform 123.

Figure 7:
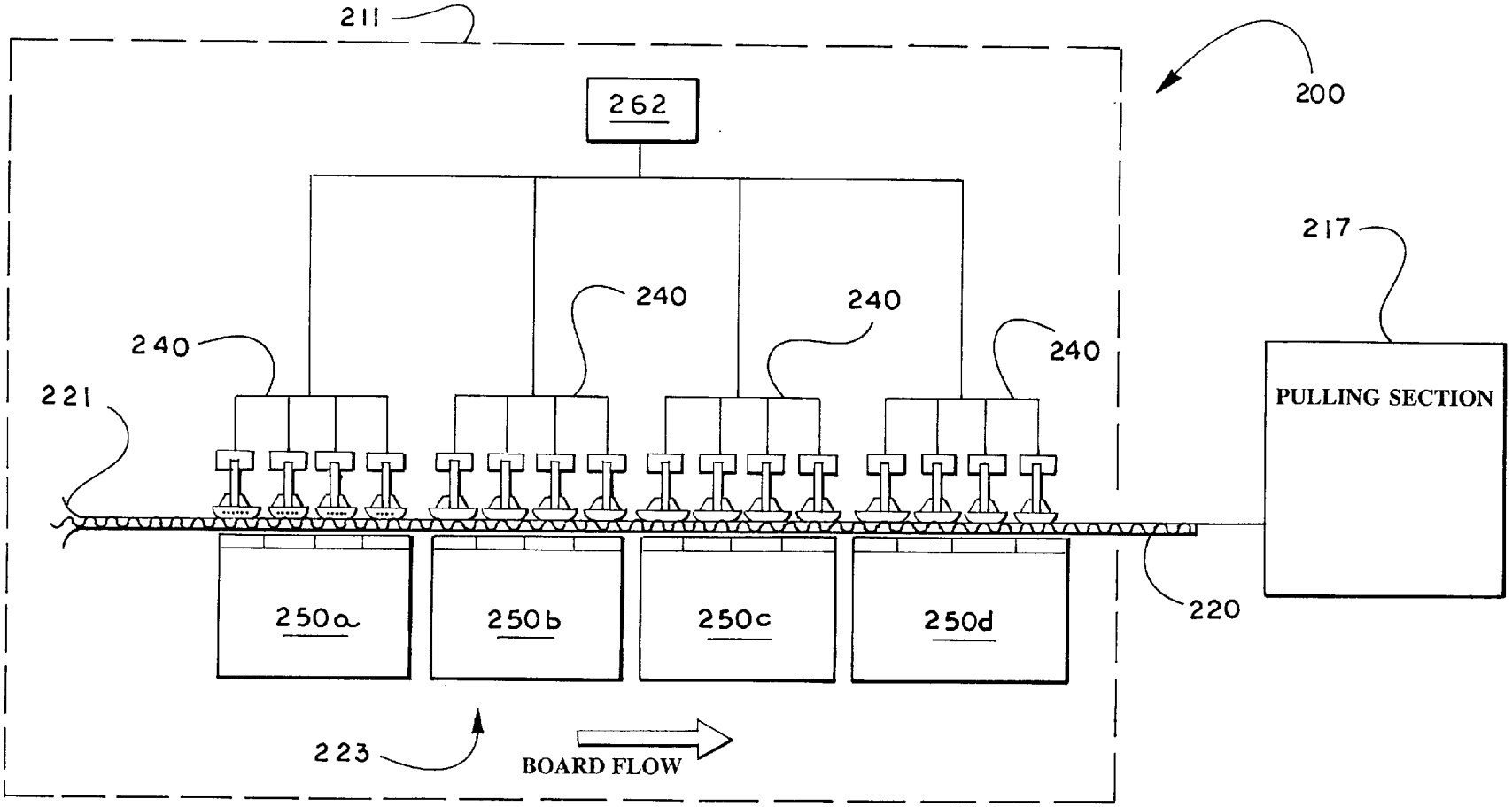
FIG. 7 is a diagram of machine for manufacturing corrugated board including top-side heat exchangers that are structurally integral with the pressure applicators.

The heat exchanger sections 140*a–c* are distributed in the cross-machine direction as shown in FIG. 6. The heat applied by the heat exchanger sections 140*a–c* in the cross machine direction may be regulated by a control device 142, as shown in FIGS. 6 and 7, in response to changes the width, thickness, wetness of the moving surface 120, and in response to the speed at which the moving surface 120 travels through the machine 100, in the same manner as the control device 45 controls the heat exchanger sections 32*a–c* and 33*a–c* in the machine 10. Temperature sensors, similar to the temperature sensor assembly 47 shown in FIG. 3, may be used to provide feedback to the control device 142. If additional heat exchangers sections are desired, additional temperature sensors may be used to allow the control device 142 to effectively regulate the heat applied by the additional heat exchangers.

Alternative Machine Configurations

FIG. 7 illustrates a beltless corrugated board manufacturing machine 200 made according to a third embodiment of the present invention. Like the machine 10 illustrated in FIGS. 1–3, this corrugated board manufacturing machine 200 also includes a hotplate section 211 and a downstream pulling section 217. The hotplate section 211 dries and sets the adhesive in a moving surface 220, which is conveyed by the pulling section 217. As with the previous embodiments, the moving surface 220 is corrugated paper board 221. Structurally integral pressure applicator and heat exchanger sections 240 are located directly above the heated platform 223 defined by the top surfaces of a plurality of steam chests 250*a–d*. Each structurally integral pressure applicator and heat exchanger section includes an independently-controlled electric heating element. The moving surface 220 passes between the structurally integral pressure applicator and heat exchanger sections 240 and the heated platform 223.

A control device 262 varies the pressure and heat applied by the structurally integral pressure applicator and heat exchanger sections 240, both in the machine direction and in the direction of machine flow, in response to changes corrugated board width, thickness, and wetness, and in response to changes in the speed of machine flow, in the same manner as the control device 46 controls the heat exchanger sections 32*a–c* and 33*a–c* in the machine 10. Thus, a two-dimensionally variable heat and pressure profile may therefore be applied to the moving surface 220 by the structurally integral pressure applicator and heat exchanger sections 240 as the moving surface passes over the heated platform 223.

Figure 8:
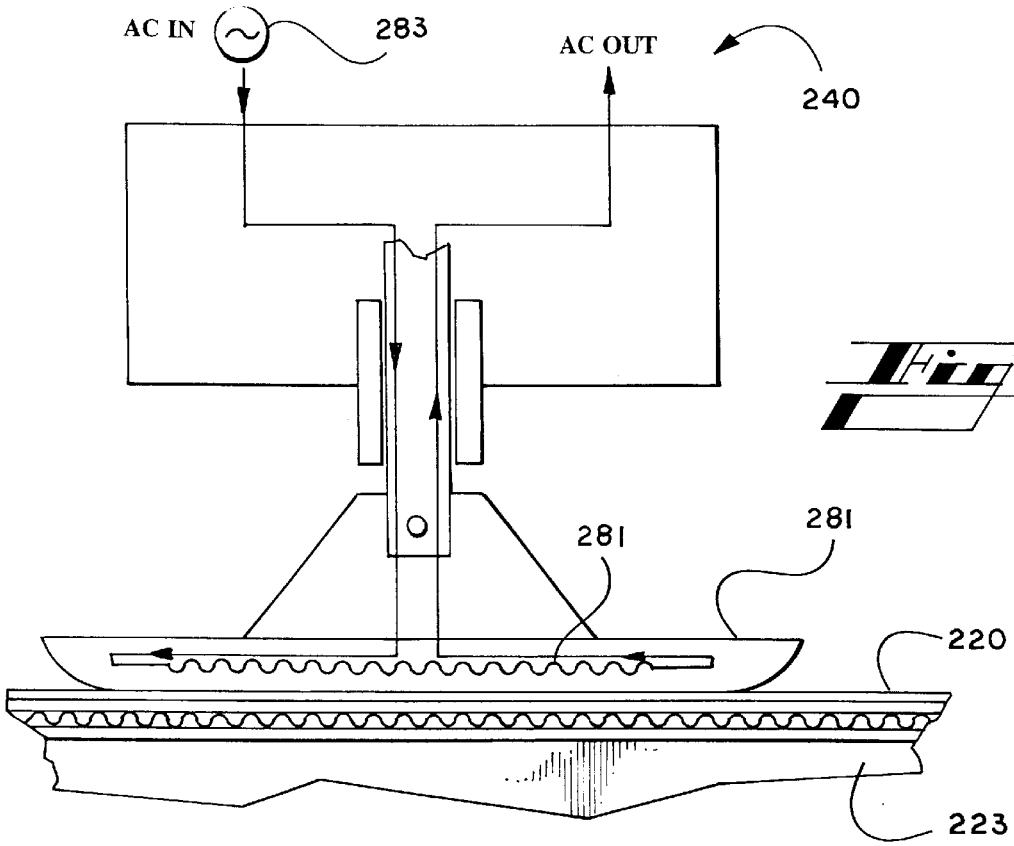
FIG. 8 is a diagram of an illustrative structurally integral pressure applicator and heat exchanger, including an electrical heating element located inside the foot of the pressure applicator.

FIG. 8 is a side elevation view of a structurally integral pressure applicator and heat exchanger section 240, which includes an electrical resistance element 281 housed within each pressure applicator foot 282. This combination pressure applicator and heat exchanger 240 is an alternative to the arrangement of separate pressure applicators and heat exchangers illustrated in FIGS. 1–4 for a machine with a beltless hotplate section. The structurally integral pressure applicator and heat exchanger section 240 applies pressure as well as heat to the moving surface 220 by direct contact and is arranged proximate to the top side of the moving surface 220. An alternating current source 283 is directed through the electrical resistance element 281, thereby heating the electrical resistance element. Heat is transferred from the electrical resistance element 281 to the applicator foot 282 by process of conduction. The bottom side of heated pressure applicator foot 282 conducts heat to the top side of the moving surface 220.

Figure 9A:
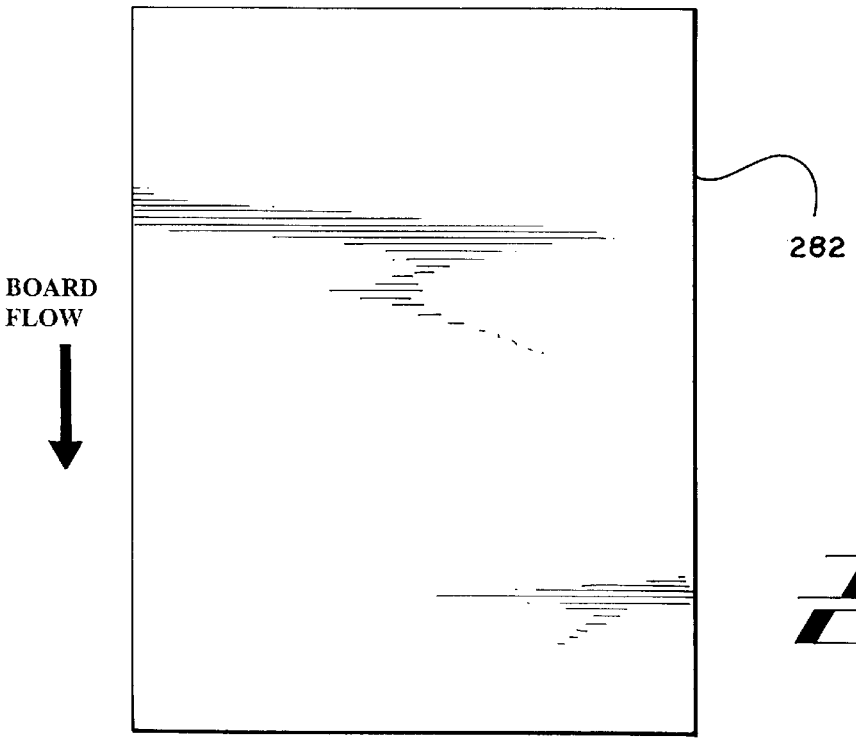
FIG. 9*a* is the bottom view of the structurally integral pressure applicator and heat exchanger of FIG. 8.
Figure 9B:
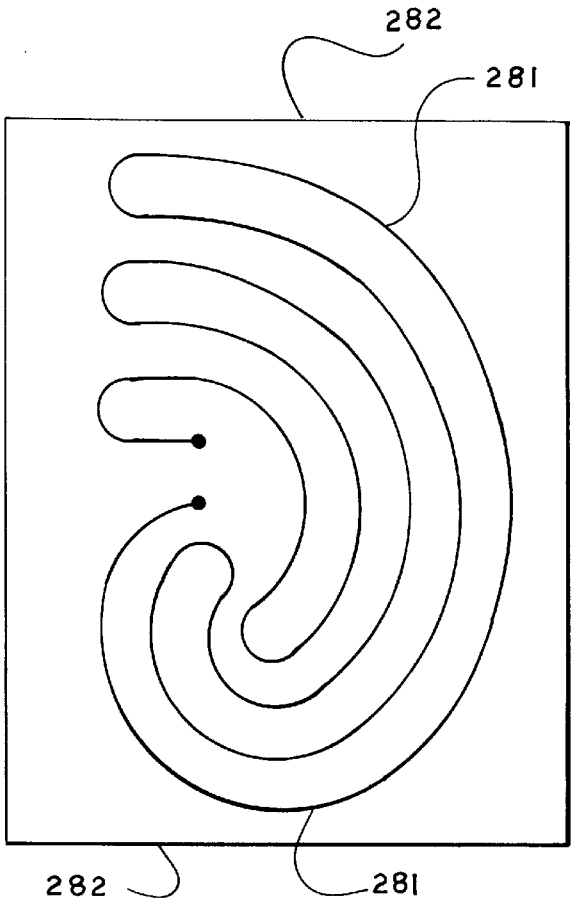
FIG. 9*b* is a sectional view of an electrical heating element inside the foot of the structurally integral pressure applicator and heat exchanger of FIG. 8.

As best shown in FIG. 9*a*, the bottom of the applicator foot 282 is preferably flat except for at least one arcuate edge at the leading edge of the foot, which is shown best in FIG. 8. The arcuate edge, or another bridge-serving device such as a flexible protective cover for one or more applicator feet, prevents the leading edge of the applicator foot 282 from snagging on the leading edge of an added layer of board 200 when the thickness of the board is increased while the machine 200 is running. FIG. 9*b* illustrates the electrical heating element 281 inside the applicator foot 282 of the structurally integral pressure applicator and heat exchanger 240.

Figure 10:
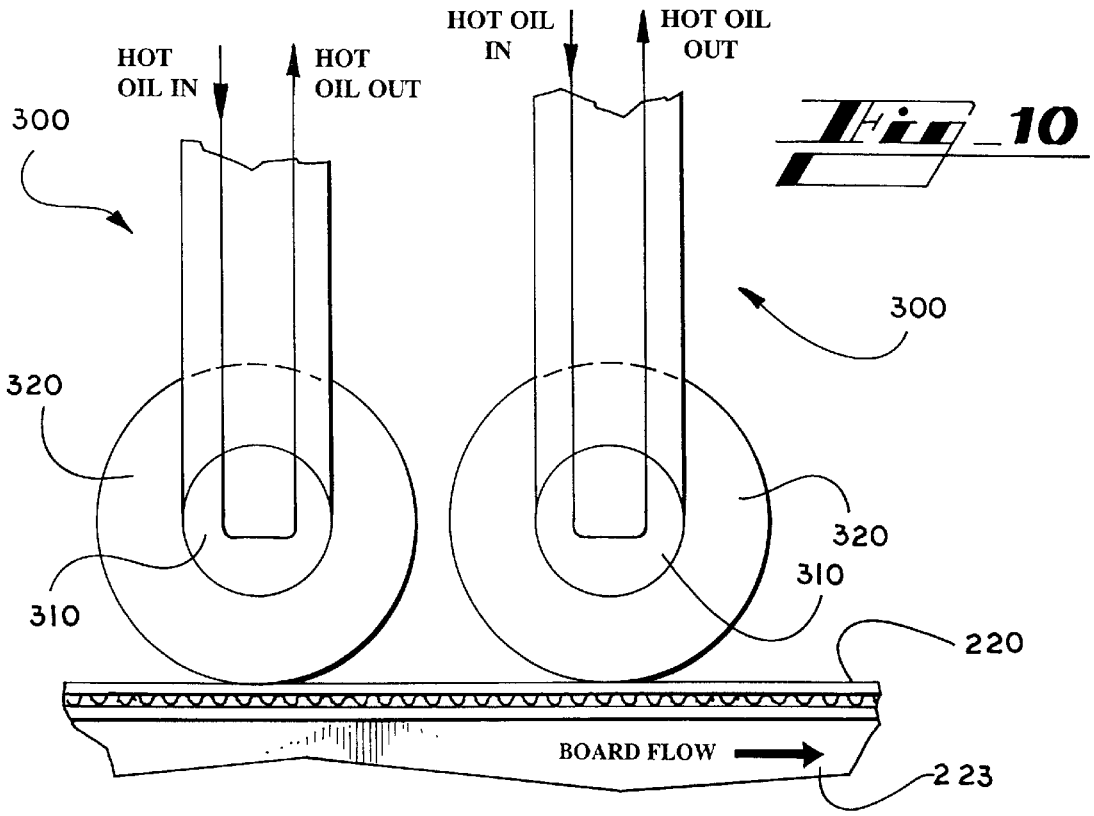
FIG. 10 is a diagram of an alternative top-side heat exchanger including a heated-oil drum that contacts the top side of the corrugated board.

FIG. 10 is a diagram of an alternative heat exchanger 300 including a heated-oil drum 310 inside a roller 320, which is positioned to contact the top side of a moving board 220. This combination pressure applicator and heat exchanger 300 is an alternative to the structurally integral pressure applicator and heat exchanger 240 described and illustrated in FIGS. 8–9*b*, and yet another alternative to the arrangement of separate pressure applicators and heat exchangers illustrated in FIGS. 1–6. That is, a grid of heat exchangers represented by the heat exchanger 300 may be used to replace the grid of structurally integral pressure applicator and heat exchangers 240 shown in FIG. 7. Alternatively, in a machine with a beltless hotplate section, one or more rows of the heat exchangers 300 may be deployed in lieu of the one or more of the top-side heat exchanger sections 32 and 33 shown in FIG. 1. And in a machine with a belt-driven hotplate section, one or more rows of the heat exchangers 300 may be deployed in lieu of the top-side heat exchanger 140 shown in FIG. 5

The heat exchangers 300 contain a heat source, such as hot oil. The drum 310 may include a heating element, such as an electric heating element, to heat the oil. Alternatively, a continuous supply of hot oil may be pumped through the drum 310 by a heat exchanger-pump arrangement. The hot oil in the drum 310 transfers heat to the contact roller 320. Heat is then transferred from the bottom of the roller 320, which is in direct contact with the top side of the moving surface 220. If more than one heat exchanger 300 is deployed, a control device may be used to vary the pressure and heat applied in the machine direction and in the direction of machine flow in response to changes corrugated board width, thickness, and wetness, and in response to changes in the speed of machine flow, in the same manner as the control device 46 controls the heat exchanger sections 32*a–c* and 33*a–c* in the machine 10.

Referring now to all of the embodiments described above, one skilled in the art should appreciate that the top-side heat exchangers deployed in a machine for manufacturing corrugated board machine may be grouped in a variety of configurations for two-dimensionally regulated heating of both sides of a moving surface. Those skilled in the art may also appreciate the variety and number of heat exchangers that may be used within each machine to vary with the heat transfer requirements in response to changes in the width, thickness, and wetness of the corrugated board, and in response to changes in the speed of machine flow. The present invention provides for several heat transfer methods to remove moisture and to set the adhesive between the layers of the corrugated board, by process of either heat convection or conduction.

This invention provides for the control and regulation of the heat applied by the heat exchanger sections to the corrugated board. One skilled in the art should appreciate that many configurations of control devices can be used to regulate the heat applied by the heat exchanger sections, both in the cross-machine direction and in the direction of the machine flow. When the manufacturer changes the width or thickness of the desired corrugated board, the control devices regulate the heat applied to sufficiently dry and to set the adhesive of the corrugated board. These control devices will enable the machine to run continuously and adjust the heat and pressure profile automatically in response to the measured of the board at the end of the hotplate section. Further, unused sections of the top-side heat exchangers may be turned off to minimize energy consumption when narrow corrugated board is manufactured.

Those skilled in the art will appreciate from the foregoing that this invention encompasses the retrofitting of existing machines for manufacturing corrugated board with heat exchangers and control devices, all within the space of the existing machine, and that the present invention can be adapted to a variety of heat exchanger types and heat exchanger configurations, with beltless and belt-driven hotplate sections. It should be understood that the foregoing relates only to specific embodiments of the invention, and that numerous changes may be made without departing from the scope of the invention defined by the following claims.

The invention claimed is:

1. A machine for applying pressure and heat to a moving surface having a top side and a bottom side, comprising:

a heated platform;

a conveyor for moving the surface relative to the heated platform so that the bottom side of the moving surface is proximate to the heated platform;

a pressure applicator section proximate to the top side of the surface for applying pressure to the top side of the surface as the surface moves between the heated platform and the pressure applicator section;

a heat exchanger section proximate to the top side of the surface for applying heat to an area including the top side of the surface as the surface moves proximate to the heat exchanger section; and a control device for varying the area over which the heat exchanger section applies heat.

2. The machine of claim 1, wherein:

the moving surface varies in width; and the heat exchanger section forms a row of independently controlled heat exchangers substantially transverse to the direction of movement of the moving surface so that the heat applied by the heat exchanger section may be varied in response to the width of the moving surface.

3. The machine of claim 2, wherein the control device varies the heat applied by the heat exchanger section substantially transverse to the direction of movement of the moving surface in response to the width of the moving surface.

4. The machine of claim 1, wherein:

the moving surface varies in thickness; and the heat exchanger section forms a column of independently controlled heat exchangers in the direction of movement of the moving surface so that the heat applied by the heat exchanger section may be varied in response to the thickness of the moving surface.

5. The machine of claim 4, wherein the control device varies the heat applied by the heat exchanger section in the direction of movement of the moving surface in response to the thickness of the moving surface.

6. The machine of claim 1, wherein:

the moving surface varies in width and thickness; and the heat exchanger section forms a grid of rows and columns of heat exchangers, the rows being substantially transverse to the direction of movement of the moving surface, and the columns being substantially parallel to the direction of movement of the moving surface, so that the heat applied by the heat exchanger section may be varied in response to the width and thickness of the moving surface.

7. The machine of claim 6, wherein the control device varies the heat applied by the heat exchanger section by rows substantially transverse to the direction of movement of the moving surface, and by columns substantially parallel to the direction of movement of the moving surface, so that the heat applied by the heat exchanger section may be varied in response to the width and thickness of the moving surface.

8. The machine of claim 1, wherein the conveyor comprises a movable belt positioned between the moving surface and the heat exchanger.

9. The machine of claim 1, wherein the conveyor comprises a pulling section located downstream from the heat exchanger section.

10. The machine of claim 1, wherein the heat exchanger section comprises a forced draft air fan that forces air across a heated element onto the top side of the moving surface.

11. The machine of claim 1, wherein the heat exchanger section comprises a heated element in direct contact with the top side of the moving surface.

12. The machine of claim 1, wherein the heat exchanger section is a first heat exchanger section, and the pressure applicator section is structurally integral with the first heat exchanger section.

13. The machine of claim 12, wherein the first heat exchanger section comprises a heated element within the pressure applicator section.

14. The machine of claim 12, wherein a second heat exchanger section is located downstream of the structurally integral pressure applicator and first heat exchanger section, proximate to the top side of the moving surface for applying heat to the top side of the moving surface as the moving surface moves proximate to the first heat exchanger section.

15. The machine of claim 1, wherein:

the heat exchanger section comprises a plurality of independently controlled heat exchanger sections arranged in series along the direction of movement of the moving surface; and the pressure applicator section comprises a plurality of independently controlled pressure applicator sections arranged in series along the direction of movement of the moving surface.

16. The machine of claim 1, wherein the moving surface comprises a corrugated board.

17. A machine for applying pressure and heat to a moving surface of varied width and thickness, the moving surface having a top side and a bottom side, comprising:

a heated platform;

a conveyor for moving the surface relative to the heated platform so that the bottom side of the moving surface is proximate to the heated platform;

a pressure applicator section proximate to the top side of the moving surface for applying pressure to the top side of the moving surface as the moving surface moves between the heated platform and the pressure applicator section; and a heat exchanger section proximate to the top side of the moving surface for applying heat to the top side of the moving surface as the moving surface moves proximate to the heat exchanger section, the heat exchanger section forming a grid of rows and columns of heat exchangers, the rows being substantially transverse to the direction of movement of the moving surface, and the columns being substantially parallel to the direction of movement of the moving surface, so that the heat applied by the heat exchanger section may be varied in response to the width and thickness of the moving surface; and a control device for varying the heat applied by the heat exchanger section in response to the width and thickness of the moving surface.

18. The machine of claim 17, wherein the conveyor comprises a movable belt positioned between the moving surface and the heat exchanger section.

19. The machine of claim 17, wherein the conveyor comprises a pulling section located downstream from the heat exchanger section.

20. The machine of claim 17, wherein the heat exchanger section comprises a forced draft air fan that forces air across a heated element onto the top side of the moving surface.

21. The machine of claim 17, wherein the heat exchanger section comprises a heated element in direct contact with the top side of the moving surface.

22. The machine of claim 17, wherein the heat exchanger section is a first heat exchanger section, and the pressure applicator section is structurally integral with the first heat exchanger section.

23. The machine of claim 22, wherein the first heat exchanger section comprises a heated element within the pressure applicator section.

24. The machine of claim 22, wherein a second heat exchanger section is located downstream of the structurally integral pressure applicator and first heat exchanger section, proximate to the top side of the moving surface for applying heat to the top side of the moving surface as the moving surface moves proximate to the first heat exchanger section.

25. The machine of claim 17, wherein:

the heat exchanger section comprises a plurality of independently controlled heat exchanger sections arranged in a series along the direction of movement of the moving surface; and the pressure applicator section comprises a plurality of independently controlled pressure applicator sections arranged in a series along the direction of movement of the moving surface.

26. The machine of claim 17, wherein the moving surface comprises a corrugated board.

27. A method for applying pressure and heat to a moving surface having a top side and a bottom side, the method comprising the steps of:

providing a heated platform;

propelling the moving surface relative to the heated platform by means of a conveyor so that the bottom side of the moving surface is proximate to the heated platform;

applying pressure with a pressure applicator section to the top side of the moving surface as the surface moves between the heated platform and the pressure applicator section such that the pressure applicator section is proximate to the top side of the moving surface; and applying heat with a heat exchanger section to the top side of the moving surface as the moving surface moves proximate to the heat exchanger section such that the heat exchanger section is proximate to the top side of the moving surface; and the heat exchanger section forms a row of independently controlled heat exchangers substantially transverse to the direction of movement of the moving surface so that the heat applied by the heat exchanger section may be varied in the direction substantially transverse to the direction of movement of the moving surface.

28. The method of claim 27, wherein:

the moving surface varies in thickness; and the heat exchanger section forms a column of independently controlled heat exchangers in the direction of movement of the moving surface so that the heat applied by the heat exchanger section may be varied in response to the thickness of the moving surface.

29. The method of claim 27, wherein:

the moving surface varies in width and thickness; and the heat exchanger section forms a grid of rows and columns of heat exchangers, the rows being substantially transverse to the direction of movement of the moving surface, and the columns being substantially parallel to the direction of movement of the moving surface, so that the heat applied by the heat exchanger section may be varied in response to the width and thickness of the moving surface.

* * * * *